US006270370B1

(12) United States Patent
Chien

(10) Patent No.: US 6,270,370 B1
(45) Date of Patent: Aug. 7, 2001

(54) ANTI-LOOSE MIDWAY ELECTRIC RECEPTACLE

(76) Inventor: Chao Chuan Chien, 8F, No. 387, Chung Cheng Road, Hsin Chuang City, Taipei Hsien (TW)

( * ) Notice: Subject to any disclaimer, the term of this patent is extended or adjusted under 35 U.S.C. 154(b) by 0 days.

(21) Appl. No.: 09/495,319

(22) Filed: Feb. 1, 2000

(51) Int. Cl.[7] ..... H01R 13/62
(52) U.S. Cl. ..... 439/371
(58) Field of Search ..... 439/371, 373, 439/501, 490, 652

(56) References Cited

U.S. PATENT DOCUMENTS 3,102,922 * 9/1963 De Lashmutt ..... 439/371
4,659,161 * 4/1987 Holcomb ..... 439/490
5,848,915 * 12/1998 Canizales ..... 439/650
5,931,702 * 8/1999 Fladung ..... 439/652

* cited by examiner

*Primary Examiner*—Brian Sircus
*Assistant Examiner*—Phuong K T Dinh
(74) *Attorney, Agent, or Firm*—Dougherty & Troxell

(57) ABSTRACT

An anti-loose midway receptacle is made of insulation material and provided with input connector and output connector with electric circuit therein. A base body of the midway body has an upright post. The post allows electric wires steadily to be wound and turned such that a dragging force to loosen an engagement of said midway receptacle.

10 Claims, 3 Drawing Sheets

ANTI-LOOSE MIDWAY ELECTRIC RECEPTACLE

BACKGROUND OF THE INVENTION

1. Field of the Invention

The present invention relates to an anti-loose midway electric receptacle, and particularly to a midway electric receptacle, with which plugs or sockets can be engaged steadily without loosening.

2. Description of Related Art

A midway electric receptacle or a power source transiting linker is frequently adopted in the daily electricity application. Usually, an electric receptacle of power source is attached to a wall in a house and it is impossible and not necessary for a lot of receptacles fixing all around in the house. It frequently occurs that an electric appliance is required to be connected a power source far away by way of the electric wire equipped on the appliance and the wire is too short to reach the power source effectively. In this way, the midway electric receptacle or the power source transiting linker such as a wire extension receptacle becomes important in order to transit the electricity from the power source to the appliance.

The wire extension receptacle or so-called tail receptacle not only can extend the power source a distance but also can provide multiple plug sockets to transmit electricity for more appliances simultaneously. Of course, when all sockets are located at the midway receptacle and plugged by appliances respectively, the safety consideration is required in order to avoid a damage caused by an overload.

In another aspect, a stable engagement of the midway receptacle is a subject worth us to care about. Basically, firm engagement between the output ends of the midway receptacle and the input ends of the appliances is a main factor for the stability. It is known that the receptacle has to be made in accordance with a strict standard and specification, but it does not mean a guarantee for the engagement without loosening.

In practice, the midway receptacle has been made in a form of base body with sockets at a lateral side thereof to allow plugs on electric appliances to be inserted. Normally, when an electric appliance such as an electric saw is operated to exert a force toward a direction away from the receptacle, it is doubtful if the engagement between the plug of the electric saw and the socket on the receptacle is reliable or not. For outdoor work, the connection wire for the midway receptacle has to be extended farther and it is much easier to occur an unsteadily plugging engagement while a dragging force is generated during the appliance is moving.

SUMMARY OF THE INVENTION

An object of the present invention is to provide a anti-loose midway receptacle which is possible to be plugged by an electric appliance stably and safely and prevent from loosening in any circumstance.

BRIEF DESCRIPTION OF THE DRAWINGS

The present invention can be more fully understood by referring to the following description and accompanying drawing, in which.

DETAILED DESCRIPTION OF THE PREFERRED EMBODIMENT

Figure 1:
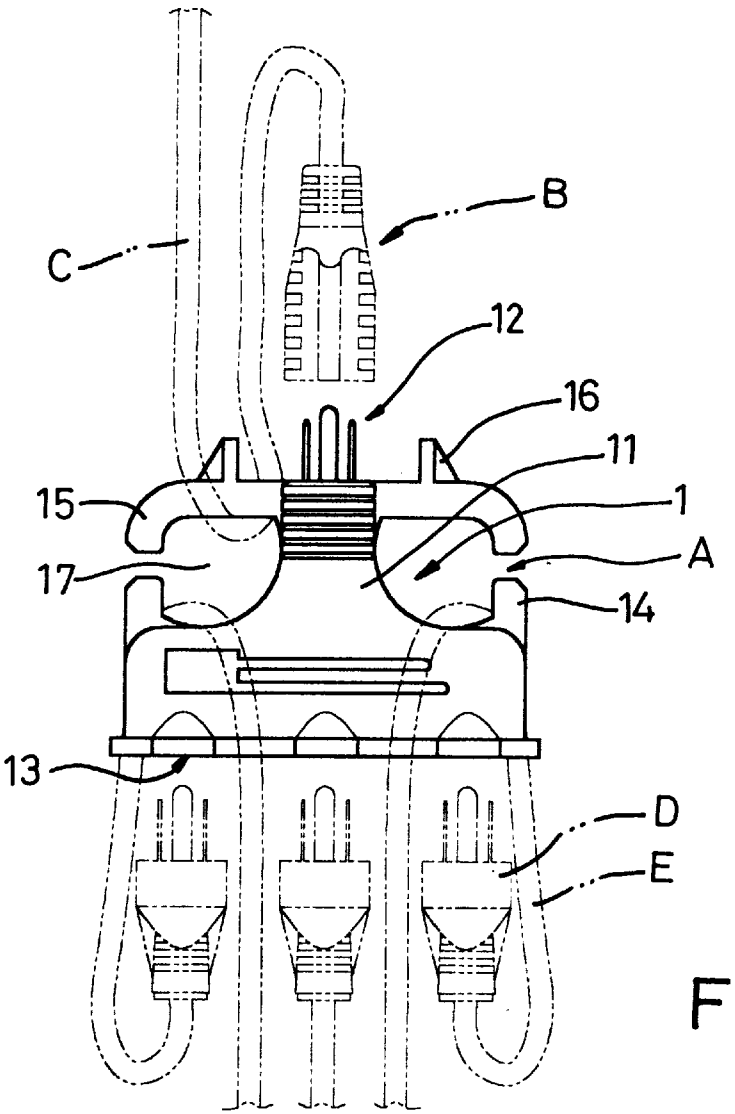
FIG. 1 is a plan view of an anti-loose midway receptacle for three plugs in a preferred embodiment according to present invention.
Figure 2:
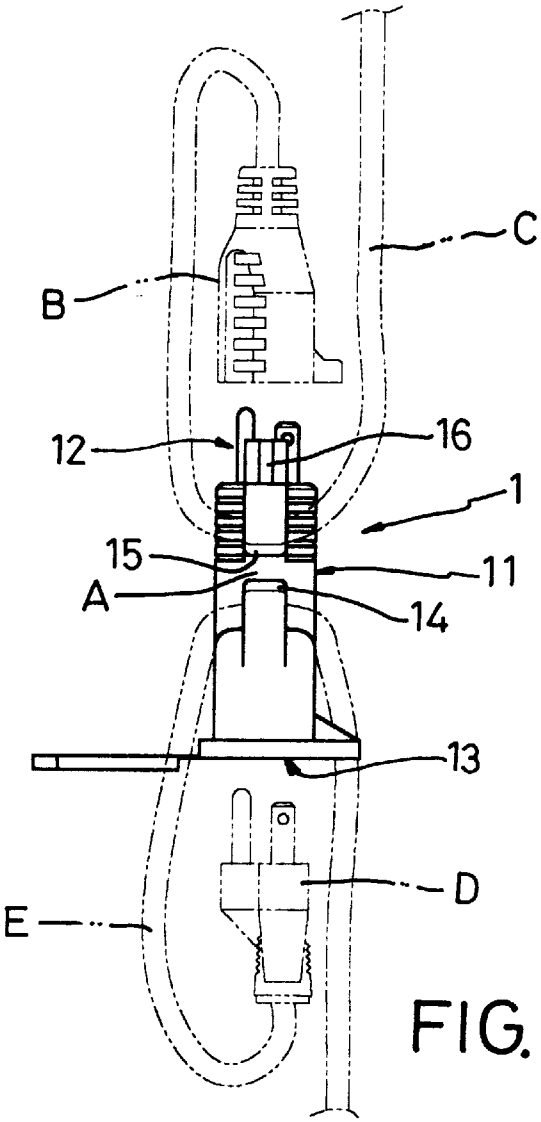
FIG. 2 is a side view of FIG. 1.

Referring to FIGS. 1 and 2, a midway receptacle 1 in a preferred embodiment according to the present invention basically is a solid body and has a base body 11. An end of the base body 11 is provided with an input connector 12 and the other end thereof has at least an output socket 13. A space in the base body 11 is provided with a related circuit such that the current can be transmitted out of the base body 11 through the output connector 13 via the input connector 12. It can be seen in FIGS. 1 and 2 that the midway receptacle 1 is provided with an input connector 12 and three output connectors 13. Because the arrangement of the input connector 12 and the output connectors 13 is a prior art, a detail will not be described further.

Both lateral sides of the base body 11 are provided with at least an upright post 14 and a concave downward edge extends from the input connector 12 to each post 14 respectively.

Besides, a stem 15 integrally extends from the input connector 12 toward these two lateral sides of the base body 11 respectively corresponding to the posts 14 each. It can be seen in FIGS. 1 and 2 that a respective end of the stems 15 has a bend opposite to the posts 14 each with a respective gap A in between such that a respective chamber 17 is formed to receive the electric wires. The size of the gap A is not less than the diameter of the electric wires used such that the electric wires can pass through. At least a respective protrusion 16 extends upward from the stems 15 each and these two protrusions 16 are oppositely positioned to locate the electric wires respectively.

Referring to FIGS. 1 and 2, a power source connector B with an electric wire C attached thereon is engaged with the input connector 12. The wire C may be wound a turn around one of the stems 15 and located at an inner side of the protrusions 16 on the stem 15. The plugs D for electric appliances are attached an electric wire E respectively. The plugs D are engaged with output connectors 13 respectively and the wires E can be bent to enter the chambers 17 through the gaps A shown in FIG. 1.

If a dragging force occurs to pull the wire E during the electric appliance is operated, the bent part of the wire E will hinder the force to disengage the plug D from the output connector 13. It can be understood that the loosening from engagement arose in the prior art can be avoided completely.

Figure 3:
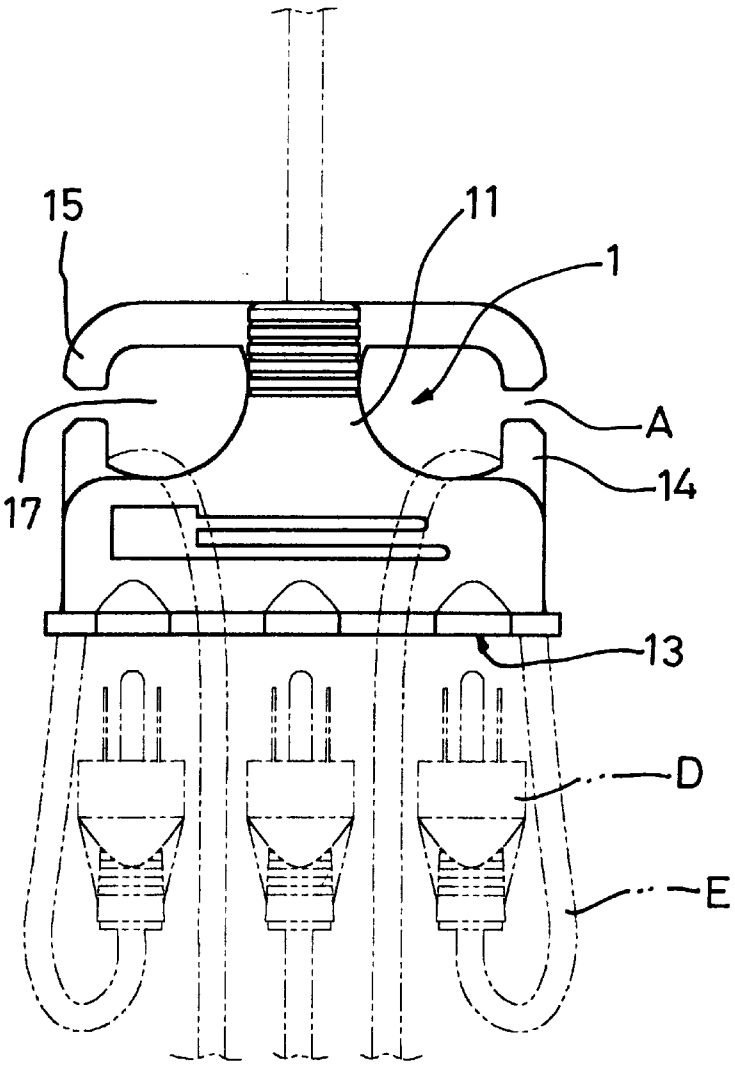
FIG. 3 is a plan view similar to FIG. 1 illustrating a second embodiment according to the present invention.

Referring to FIG. 3, a second embodiment of a midway receptacle similar to that shown in FIGS. 1 and 2 is illustrated. The power source connecting part is integrally made with the midway receptacle. Therefore, the protusions 16 provided in the first embodiment are not necessary in the present embodiment.

Figure 4:
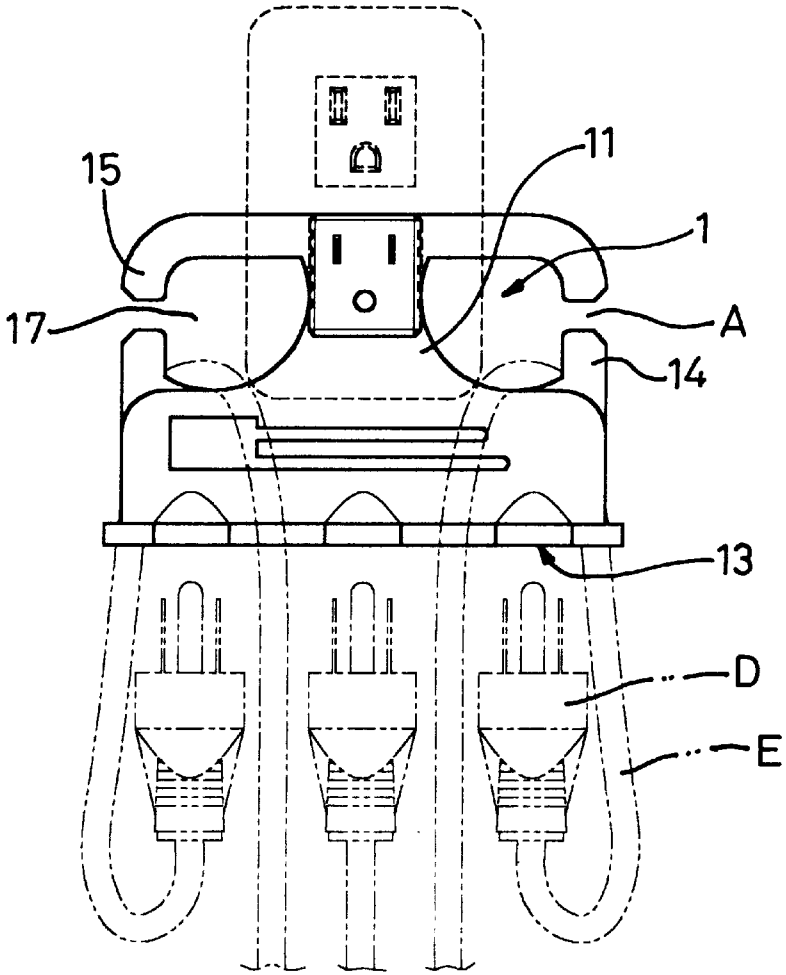
FIG. 4 is a plan view similar to FIG. 1 illustrating a third embodiment according to the present invention.

Referring to FIG. 4, a third embodiment of a midway receptacle similar to that shown in FIGS. 1 and 2 is illustrated. The connecting part of power source in the present embodiment is a plug or a socket instead. The midway receptacle can be engaged with a socket or a plug on a wall or on a prior art wire extension receptacle directly. Therefore, the protrusions 16 provided in the first embodiment are not necessary in the third embodiment either.

Figure 5:
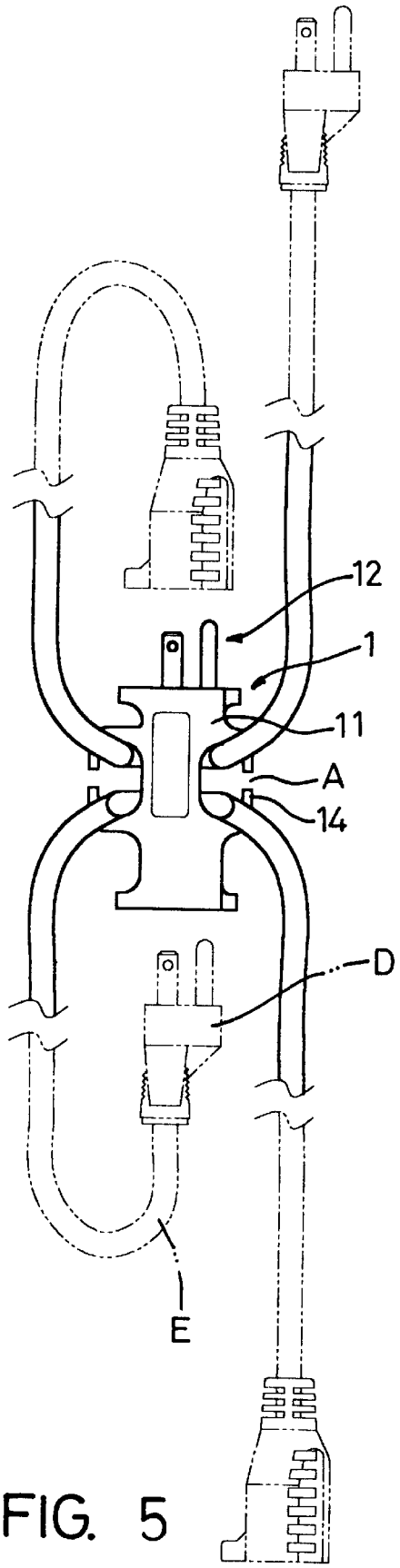
FIG. 5 is a plan view similar to FIG. 2 illustrating a fourth embodiment according to the present invention.
Figure 6:
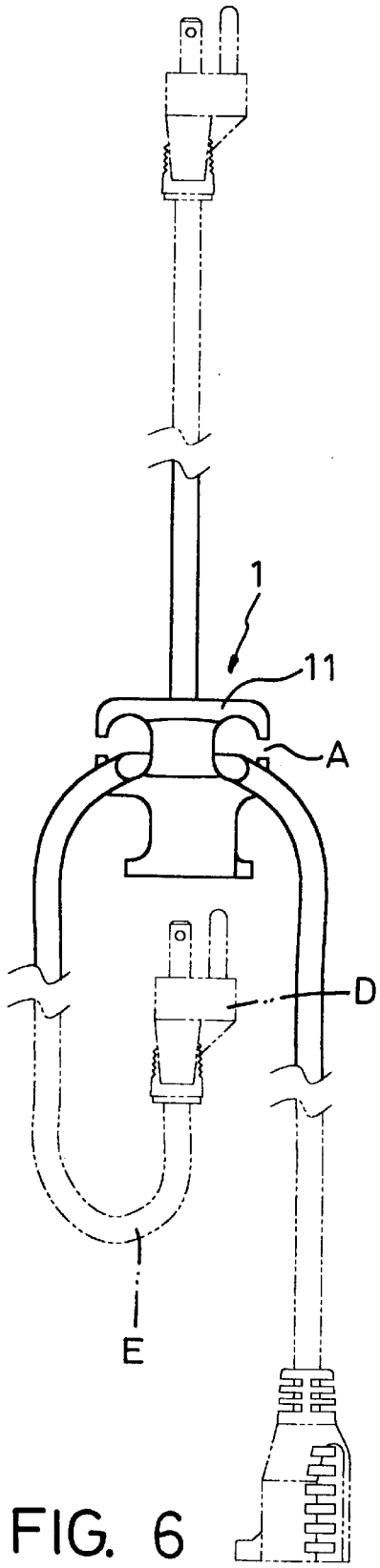
FIG. 6 is plan view similar to FIG. 5 illustrating a fifth embodiment according the present invention.

Referring to FIG. 5, a fourth embodiment of midway receptacle is illustrated. The midway receptacle 1 is made in a form that the wire of the power source connector may pass through and wind a turn while engaging with the input connector 12. Similarly, the wire E of the plug D for an electric appliance may pass through the chambers either and wind a turn before engaging with the output connector. It can be understood that a dragging force exerting the wires will not cause to loosen the engagement of the midway receptacle. The embodiment shown in FIG. 6 is similar to the fourth embodiment except the input connector being replaced by an integral wire extended plug. In FIGS. 5 and 6, it can be seen that a gap A is also provided at each chamber in the fourth and fifth embodiments to allow the wires passing through as in the preceding embodiments.

It can be appreciated that the midway receptacle of the present invention has an arrangement that a pull force induced by moving an electric appliance will not cause a dragging force to loosen the engagement between a plug and a socket. Therefore, the electricity can be transmitted from a power source steadily through the midway receptacle without interruption.

While the invention has been described with reference to preferred embodiment thereof, it is to be understood that modifications or variations may be easily made without departing from the spirit of this invention, which is defined by the appended claims.

What is claimed is:

1. An anti-loosening midway electrical receptacle comprising:

a) a receptacle base body with opposite lateral sides, and having an electrical power inlet and at least one electrical output connector;

b) an upright post extending from each opposite lateral side of the base body; and, c) a stem extending outwardly from each opposite lateral side of the base body aligned with a corresponding upright post, an end of the stem spaced from the corresponding upright post so as to form a gap therebetween, such that stems, the upright posts and the base body bound two chambers, each chamber configured to accept passage of an electrical power cord therethrough so as to prevent loosening of a plug thereon connected to the at least one electrical output connector.

2. The anti-loosening midway electrical connector of claim 1 further comprising a plurality of female electrical output connectors.

3. The anti-loosening midway electrical connector of claim 1 wherein the electrical power inlet comprises a male electrical plug.

4. The anti-loosening midway electrical connector of claim 1 wherein the electrical power inlet comprises an electrical power cord extending from the base body.

5. The anti-loosening midway electrical connector of claim 1 further comprising a protrusion extending from at least one of the stems.

6. An anti-loosening midway electrical receptacle assembly comprising:

a) a receptacle base body with opposite lateral sides, and having an electrical power inlet and at least one electrical output connector;

b) an upright post extending from each opposite lateral side of the base body;

c) a stem extending outwardly from each opposite lateral side of the base body aligned with a corresponding upright post, an end of the stem spaced from the corresponding upright post so as to form a gap therebetween, such that stems, the upright posts and the base body bound two chambers, each chamber configured to accept passage of an electrical power cord therethrough; and, d) an electrical plug connected to an electrical cord, the electrical cord passing through at least one of the chambers when the electrical plug engages the at least one electrical power output connector, so as to prevent loosening of the electrical plug when a force is exerted on the electrical cord.

7. The anti-loosening midway electrical connector of claim 6 further comprising a plurality of female electrical output connectors.

8. The anti-loosening midway electrical connector of claim 6 wherein the electrical power inlet comprises a male electrical plug.

9. The anti-loosening midway electrical connector of claim 6 wherein the electrical power inlet comprises an electrical power cord extending from the base body.

10. The anti-loosening midway electrical connector of claim 6 further comprising a protrusion extending from at least one of the stems.

* * * * *